United States Patent [19]

Houtkamp

[11] Patent Number: 4,855,586

[45] Date of Patent: Aug. 8, 1989

[54] X-RAY DETECTOR TUBE WITH SIDEWALL-SUPPORTING REAR WALL

[75] Inventor: Johannes J. Houtkamp, Delft, Netherlands

[73] Assignee: B.V. Optische Industrie "De Oude Delft", Delft, Netherlands

[21] Appl. No.: 837,013

[22] Filed: Mar. 6, 1986

[30] Foreign Application Priority Data

Mar. 13, 1985 [NL] Netherlands ..... 8500709

[51] Int. Cl.[4] ..... H01J 31/50

[52] U.S. Cl. ..... 250/213 VT; 313/526

[58] Field of Search ..... 250/213 VT; 313/526, 313/544, 634

[56] References Cited

U.S. PATENT DOCUMENTS

| | | | |
|---|---|---|---|
| Re. 30,596 | 4/1981 | Cuelenaere et al. | 313/526 |
| 3,735,140 | 5/1973 | Stimler | 250/213 VT |
| 3,887,810 | 6/1975 | Skaggs | 250/213 VT |
| 3,894,258 | 7/1975 | Butterwick | 313/526 |
| 3,904,065 | 9/1975 | Shrader | 313/526 |
| 4,045,700 | 8/1977 | Wulff | 250/213 VT |
| 4,255,666 | 3/1981 | Wang et al. | 250/213 VT |
| 4,304,998 | 12/1981 | Cushman | 250/213 VT |
| 4,550,251 | 10/1985 | Zitelli et al. | 250/213 VT |
| 4,658,128 | 4/1987 | Beierlein | 250/213 VT |

*Primary Examiner*—David C. Nelms
*Assistant Examiner*—Khaled Shami
*Attorney, Agent, or Firm*—Louis E. Marn

[57] ABSTRACT

An X-ray detector tube comprising an essentially rectangular, elongate housing (1) having a forward wall, a rear wall and sidewalls, which tube has an elongate proximity focus image intensifier mounted therein and which housing has a vacuum established therein, in which the rear wall (5) of the tube exhibits a considerably higher resistance to deformation than the sidewalls.

24 Claims, 1 Drawing Sheet

X-RAY DETECTOR TUBE WITH SIDEWALL-SUPPORTING REAR WALL

The invention relates to an X-ray detector tube comprising an essentially rectangular, elongate housing having a forward wall, a rear wall and sidewalls, which tube has an elongate proximity focus image intensifier mounted therein and which housing has a vacuum established therein.

Such an X-ray detector tube having one cathode and one anode is disclosed in Dutch patent application No. 84,01105. Such detector tubes entail the advantage that, on account of their elongate shape, they are extremely suitable for use, inter alia, in tomography or in slit-scan radiography, in which by means of a narrow X-ray beam a striplike X-ray image can be formed on the anode of the detector tube. As the X-ray image is striplike, the use of an elongate anode is considerably more advantageous than that of a conventional circular anode. For displaying the X-ray image, the anode is coated with a phosphor layer the phosphor particles of which exhibit luminscence when hit by electrons emitted by the associated cathode.

Proximity focus type X-ray detector tubes having walls made of metal are known in the art; see for example U.S. Pat. No. 4,300,046. In such tubes, the forward wall is provided with an X-ray pervious window of, for example, thin stainless steel and the sidewall ends facing the rear wall have a metallic flange welded thereto, on which flange a glass window for viewing the image formed on the anode is mounted by a vacuum tight seal. However, especially if the X-ray detector tube is of rectangular, elongate shape, the metallic walls of the tube may deform during and after the evacuation of the enclosure. Moreover, the metallic flange mounting the anode window may deform during or after evacuation too, causing tensile forces to be exerted on the seal between the metal and the glass window, which is particularly undesirable in such metal-glass seals and may result in the seal becoming defective so that the interior of the tube is no longer in vacuum.

In such tubes, deformation can be prevented only by either making the enclosure and the flange of very thick material, with all consequent drawbacks, or forming a stay structure in the interior of the tube, which structure, however, occupies valuable room and increase the manufacturing costs of the tube. Moreover, both solutions result in a substantial increase in weight of the tube, whcih causes additional problems when it is to be used in, for example tomography.

It is therefore an object of the invention to provide a simple and low cost solution to the above problem, which solution obviates the risk of the metal-glass seals in the tube being subjected to tensile forces and becoming defective during or after the evacuation of the enclosure of an X-ray detector tube.

To achieve this object, the invention provides an X-ray detector tube of the above type in which the rear wall of the tube exhibits a considerably higher resistance to deformation than the sidewalls.

By giving the rear wall of the tube a considerably higher resistance to deformation than the sidewalls in accordance with the invention, the rear wall is able to support the sidewalls against bending over a portion of their height. To this end, the rear wall preferably rests on support means secured to each of the sidewalls at points spaced some distance from the rearward ends thereof, while the rear wall is sealed in vacuum tight fashion to the sidewalls, for example by a frit seal. Due to the support given by the rear wall, the sidewalls are prevented from bending to an appreciable extent in response to the vacuum in the tube, while on account of this vacuum the frit seal between the rear wall and the sidewalls is only subjected to compression forces, to which such a seal is well resistant.

The rear wall for the X-ray detector tube according to the invention may be made of, for example, glass, ceramic material or metal. In the event of a glass rear wall, an anode screen mounted in the tube can be viewed through this rear wall but it is also possible to mount the anode screen directly on the inner face of the glass rear wall. Also, a window may be provided in the glass rear wall, with the anode screen mounted on the inner face of the window. In the event of a ceramic or metallic rear wall, self-evidently such a window wil be imperative. The window may be made of glass or glass fibre plate. To achieve a proper seal between the rear wall and the window, the walls of the opening in the rear wall for receiving the window preferably converge into the direction of the interior of the tube and the window has a corresponding shape, so that the sealing material between the window and the rear wall is only subjected to pressure in response to the vacuum in the tube.

In accordance with a further embodiment of the detector tube according to the invention, all walls of the tube are made of glass, with the rear wall having a greater thickness than the sidewalls. The walls may be glass plates connected to each other in vacuum tight fashion by means of, for example, frit seals. However, it is also possible to form the enclosure out of a single piece of glass.

The invention will be described in greater detail hereinafter with reference to a number of embodiments and in conjunction with the drawing, in which.

Figure 1:
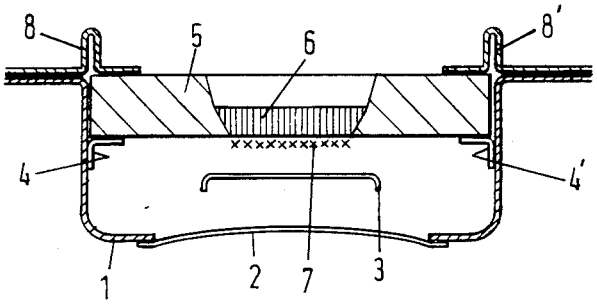
FIG. 1 shows in cross-sectional view a first embodiment of the detector tube according to the invention.

FIG. 1 shows a metallic enclosure 1 having an X-ray previous window, for example of thin stainless steel. secured in vacuum tight fashion to its forward wall. A cathode support 3 is mounted in known per se fashion within enclosure 1. The X-ray screen with the photocathode are provided in conventional fashion on the cathode support.

Support means 4 and 4' are secured to the sidewalls of the enclosure at points spaced some distance from the rearward ends thereof. A glass rear wall 5 rests on these suport means. Besides of glass, the rear wall may be made of a ceramic material or a metal. In the event of a ceramic or metallic rear wall and, if desired, also in the event of a glass rear wall, a window 6 is provided in the rear wall, which window may be of glass or glass fibre plate. An anode phosphor is provided on the inner face of the window or, in the absence of such a window, on the inner face of the glass rear wall. In the event of a rear wall of glass plate, the anode may also be mounted at some distance from the inner face of the rear wall, with the rear wall serving as a window for viewing the anode screen.

The elongate opening in rear wall 5 for receiving window 6 is preferably shaped to taper into the direction of the interior of the tube, with the window shaped correspondingly, and a vacuum tight seal of, for example, frit is provided between the window and the rear wall. In this preferred embodiment of the opening for the window in the rear wall, the vacuum in the tube will result in such a force being exerted on the window that it locks itself in the opening, with the frit seal being subjected only to compression forces to which such a seal is extremely well resistant.

Rear wall 5 is sealed in vacuum tight fashion to the sidewalls, for example by means of a frit seal. On account of the vacuum in the interior of the tube, this seal is likewise subjected only to compression forces. The sidewalls of enlclosure 1 are in closely fitting contact with the sides of rear wall 5, so that this rear wall supports the sidewalls against bending. The thickness of the rear wall is considerably larger than the thickness of the material of the enclosure. When using a glass or ceramic plate as the rear wall, a thickness of about 16 mms for this rear wall has proven very satisfactory, in which case sidewalls of a thickness of about 2 mms could be used, whereas if no such thick rear wall would have been used, these sidewalls should have had a thickness of at least 5 to 6 mms in order to be properly resistant to bending.

The rearward ends of the sidewalls of the enclosure will preferably be bent over outwardly and have retaining means 8 and 8' secured to the resultant flanges, these retaining means 8, 8' and support means 4, 4' defining channels for receiving the rear wall. Retaining means 8, 8' may be sealed to rear wall 5 by a frit seal and may to this end be so biased that this frit seal is only subjected to pressure. Retaining means 8, 8' may be secured in vacuum tight fashion to the metallic enclosure by, for example, a soldered joint, an indium or an argon arc welded joint.

Figure 2:
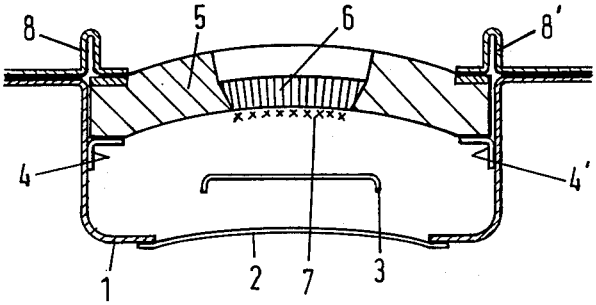
FIG. 2 show in cross-sectional view a modification of the detector tube according to FIG. 1.

FIG. 2 shows in cross-sectional view a detector tube of essentially the same structure as the tube shown in FIG. 1. Consequently, corresponding components have been designated by identical reference numerals. The embodiment of FIG. 2 is distinct from that of FIG. 1 in that rear wall 5 is convex in a direction away from the tube. By giving rear wall 5 a suitable curvature in the manner shown, this wall may be of lesser thickness than the flat rear wall of the tubing according to FIG. 1. With the interior of the tube being evacuated, the atmospheric pressure on the convex outer face of the rear wall 5 will compensate for the inwardly directed pressure exerted by the sidewalls.

Figure 3:
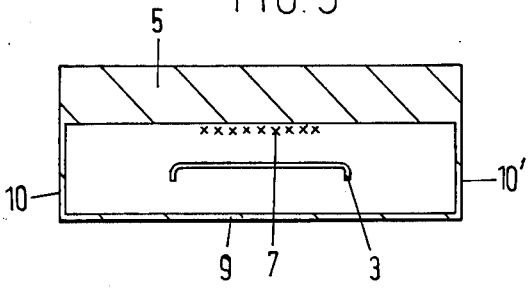
FIG. 3 shows in cross-sectional view another embodiment of the detector tube according to the invention.

FIG. 3 shows another embodiment of the detector tube according to the invention, again with corresponding components designated by identical reference numerals.

In the embodiment of FIG. 3, not only rear wall 5 but also forward wall 9 and sidewalls 10, 10° of the enclosure are made of glass. Also in this embodiment rear wall 5 is of considerably greater thickness than the sidewalls and the forward wall in order to support the sidewalls against bending. The different walls of the enclosure of the detector tube of FIG. 3 may be made of glass plates interconnected in vacuum tight fashion by, for example, frit seals. However, it is also possible to form or mould the entire enclosure of the detector tube of FIG. 3 from a single piece of glass, in which enclosure the cathode and the anode can be provided in a suitable manner.

It will be clear that, though only three possible embodiments of the detector tube according to the invention are described above, a large number of variations and modifications is feasible within the scope of the present invention, in each of which the rear wall exhibits a considerably higher resistance to deformation than the sidewalls and the forward wall and functions as a support for the sidewalls and the forward wall.

I claim:

1. An X-ray detector tube, which comprises an essentially rectangular, elongate housing haveing a forward wall, a rear wall and sidewalls, said tube having an elongate proximity focus image intensifier mounted therein, said housing having a vacuum established therein, said rear wall of said tube exhibiting a higher resistance to deformation than said sidewalls, said rear wall supporting said sidewalls against bending.

2. The X-ray detector tube according to claim 1, characterized in that said rear wall is made of glass.

3. The X-ray detector tube according to claim 1, characterized in that said rear wall is made of a ceramic material.

4. The X-ray detector tube according to claim 1, characterized in that said rear wall is made of metal.

5. The X-ray detector tube according to claim 2, characterized in that an anode is provided on a face of said rear wall facing interiorly of said tube.

6. The X-ray detector tube according to claim 1, characterized in that the outside of said rear wall of said tube is convex.

7. The X-ray detector tube according to claim 1, characterized in that all vacuum tight connections in said tube are subject essentially only to compression forces.

8. The X-ray detector tube according to claim 1, characterized in that said forward wall and said sidewalls are made of metal and further including an X-ray previous window provided in said forward wall, a support means being secured to each sidewall at a point spaced a distance from a rearward end thereof, said rear wall resting on said support means, and said rear wall being connected in vacuum tight fashion to said sidewalls.

9. The X-ray detector tube according to claim 1, characterized in that said forward wall and said sidewalls are made of metal and further including an X-ray pervious window provided in said forward wall, a support means being secured to each sidewall at a point spaced a distance from a rearward end thereof, said rear wall resting on said sidewalls, said sidewalls being bent over outwardly forming a flange, a retaining means being secured in vacuum tight fashion to each flange so that said support means and said retaining means on each sidewall define a slot-shaped channel in which said rear wall is received, said rear wall being connected in vacuum tight fashion to said retaining means.

10. An X-ray detector tube according to claim 1, characterized in that a window is mounted in vacuum tight fashion in the rear wall.

11. The X-ray detector tube according to claim 10, characterized in the said window is made of an optical fibre plate.

12. The X-ray detector tube according to claim 10, characterized in that said window is mounted in an elongate opening in said rear wall shaped to taper in a direction interiorly of said tube, said window being connected to said sidewalls of said opening by a frit seal.

13. The X-ray detector tube according to claim 10, characterized in that said anode is formed on a face of said window facing interiorly of said tube.

14. The X-ray detector tube according to claim 13, characterized in that said forward wall, said rear wall and said sidewalls of said housing are made of glass.

15. The X-ray detector tube according to claim 14, characterized in that said walls are glass plates interconnected in vacuum tight fashion by frit seals.

16. The X-ray detector tube according to claim 14, characterized in that said anode is formed on a face of said rear wall facing interiorly of said tube.

17. The X-ray detector tube according to claim 14, characterized in that a window is provided in vacuum tight fashion in said rear wall.

18. The X-ray detector tube according to claim 15, characterized in that said window is made of an optical fibre plate.

19. The X-ray detector tube according to claim 17, characterized in that said window is mounted in an elongate opening in said rear wall shaped to taper in a direction interiorly of said tube, said window being connected to said sidewalls of said opening by a frit seal.

20. The X-ray detector tube according to claim 17, characterized in that said anode is formed on a face of said window facing interiorly of said tube.

21. The X-ray detector tube according to claim 9, characterized in that a window is mounted in vacuum tight fashion in said rear wall.

22. The X-ray detector tube according to claim 21, characterized in that said window is made of an optical fibre plate.

23. The X-ray detector tube according to claim 21, characterized in that said window is mounted in an elongate opening in said rear wall shaped to taper in a direction interiorly of said tube, said window being connected to said sidewalls of said opening by a frit seal.

24. The X-ray detector tubing according to claim 21, characterized in that said anode is formed on a face of said window facing interiorly of said tube.

* * * * *

UNITED STATES PATENT AND TRADEMARK OFFICE

CERTIFICATE OF CORRECTION

PATENT NO. : 4,855,586

DATED : AUGUST 8, 1989

INVENTOR(S) : JOHANNES J. HOUTKAMP

It is certified that error appears in the above-identified patent and that said Letters Patent is hereby corrected as shown below:

In the Specification

Column 2, line 18, "wil", should read -- will --;

line 57, "suport", should read -- support --.

Column 3, line 16, "enlclosure", should read -- enclosure --.

In the Claims

Claim 1, line 11, "haveing", should read -- having --.

Claim 8, line 39, "previous", should read -- pervious --.

Signed and Sealed this

Sixteenth Day of April, 1991

*Attest:*

*Attesting Officer*

HARRY F. MANBECK, JR.

*Commissioner of Patents and Trademarks*